US011823609B2

(12) United States Patent
Wang et al.

(10) Patent No.: US 11,823,609 B2
(45) Date of Patent: Nov. 21, 2023

(54) METHOD AND APPARATUS FOR GAMMA DEBUGGING

(71) Applicant: KunShan Go-Visionox Opto-Electronics Co., Ltd, Jiangsu (CN)

(72) Inventors: Yuqing Wang, Kunshan (CN); Xinquan Chen, Kunshan (CN); Xiaobao Zhang, Kunshan (CN); Chong Han, Kunshan (CN)

(73) Assignee: KunShan Go-Visionox Opto-Electronics Co., Ltd, Kunshan (CN)

( * ) Notice: Subject to any disclaimer, the term of this patent is extended or adjusted under 35 U.S.C. 154(b) by 0 days.

(21) Appl. No.: 17/835,447

(22) Filed: Jun. 8, 2022

(65) Prior Publication Data

US 2022/0301482 A1 Sep. 22, 2022

Related U.S. Application Data

(63) Continuation of application No. PCT/CN2021/089291, filed on Apr. 23, 2021.

(30) Foreign Application Priority Data

Jun. 29, 2020 (CN) ..... 202010602541.7

(51) Int. Cl.
*G09G 3/00* (2006.01)
*G09G 3/20* (2006.01)

(52) U.S. Cl.
CPC ..... *G09G 3/2074* (2013.01); *G09G 3/006* (2013.01); *G09G 2320/0233* (2013.01); *G09G 2320/0626* (2013.01); *G09G 2320/0673* (2013.01)

(58) Field of Classification Search
CPC ..... G09G 3/32; G09G 3/00; G09G 3/006; G09G 2320/0233; G09G 3/3291
See application file for complete search history.

(56) References Cited

U.S. PATENT DOCUMENTS 10,311,798 B2 6/2019 Lee et al.
2016/0104429 A1* 4/2016 Kang ..... G09G 3/3291 345/212

FOREIGN PATENT DOCUMENTS

CN 108766347 A 11/2018
CN 109166559 A 1/2019
(Continued)

OTHER PUBLICATIONS

English translation of CN110599957.*
(Continued)

*Primary Examiner* — Michael A Faragalla
(74) *Attorney, Agent, or Firm* — Maier & Maier, PLLC

(57) ABSTRACT

A method for Gamma debugging. The method for Gamma debugging is applicable to a display panel including a first display area and a second display area. A light transmittance of the first display area is greater than that of the second display area. The method includes: selecting, in the second display area, a test area having a same shape and size as the first display area; obtaining a first present brightness value when the test area corresponds to a specified register value under a specified grayscale; determining a plurality of first target brightness values when the first display area corresponds to a plurality of register values under the specified grayscale, according to the first present brightness value and a linear relationship between register values and brightness of the display panel; and performing Gamma debugging on the first display area according to the first target brightness values.

20 Claims, 5 Drawing Sheets

(56) References Cited

FOREIGN PATENT DOCUMENTS

| | | | | | |
|---|---|---|---|---|---|
| CN | 109979389 | A | | 7/2019 | |
| CN | 110021272 | A | | 7/2019 | |
| CN | 110299104 | A | | 10/2019 | |
| CN | 110599957 | | * | 12/2019 | ..... G09G 3/3208 |
| CN | 110599957 | A | | 12/2019 | |
| CN | 111223437 | A | | 6/2020 | |
| CN | 111833793 | A | | 10/2020 | |

OTHER PUBLICATIONS

International Search Report (with English Translation) and International Written Opinion dated Jul. 28, 2021, in corresponding International Application No. PCT/CN2021/089291, 15 pages.
First Office Action dated Mar. 7, 2022, corresponding to Chinese Application No. 202010602541.7; 17 pages, (with English Translation).
The Notification to Grant Patent Right for Invention dated May 16, 2022, corresponding to Chinese Application No. 202010602541.7, 7 pages (with English Translation).

* cited by examiner

METHOD AND APPARATUS FOR GAMMA DEBUGGING

CROSS REFERENCE TO RELATED APPLICATION

The present application is a continuation of International Application No. PCT/CN2021/089291 filed on Apr. 23, 2021, which claims the priority to Chinese Patent Application No. 202010602541.7 filed on Jun. 29, 2020, both of which are incorporated herein by reference in their entireties.

TECHNICAL FIELD

The present application relates to the field of display, and particularly to a method and apparatus for Gamma debugging.

BACKGROUND

With rapid development of electronic devices, users have higher and higher requirements for screen-to-body ratios. As a result, the industry has shown more and more interest in all-screen displays of electronic devices.

Currently, a design of under-screen camera has appeared. The under-screen camera refers to a camera which is located under a display screen but will not affect a display function of the display screen. The display screen above the camera can display an image normally when the camera is not used by a user, and the display screen above the camera does not display an image when the camera is used by a user.

However, there is a problem of brightness inconsistency between a position where a camera is arranged and a position where no camera is arranged when a display screen displays.

SUMMARY

The present application provides a method and apparatus for Gamma debugging, which can improve brightness consistency of a display panel. In a first aspect, the present application provides a method for Gamma debugging, which is applicable to a display panel including a first display area and a second display area. A light transmittance of the first display area is greater than a light transmittance of the second display area. The method includes: selecting, in the second display area, a test area which has a same shape and size as the first display area; obtaining a first present brightness value of the test area when the test area corresponds to a specified register value under a specified grayscale; determining a plurality of first target brightness values of the first display area when the first display area corresponds to a plurality of register values under the specified grayscale, according to the first present brightness value and a linear relationship between register values and brightness of the display panel; and performing Gamma debugging on the first display area according to the plurality of first target brightness values.

In a second aspect, the present application provides an apparatus for Gamma debugging, the apparatus is applicable to a display panel including a first display area and a second display area. A light transmittance of the first display area is greater than a light transmittance of the second display area. The apparatus includes: a test area selecting module, configured to select, in the second display area, a test area which has a same shape and size as the first display area; a present brightness value obtaining module, configured to obtain a first present brightness value of the test area when the test area corresponds to a specified register value under a specified grayscale; a target brightness value determination module, configured to determine a plurality of first target brightness values of the first display area when the first display area corresponds to a plurality of register values under the specified grayscale, according to the first present brightness value and a linear relationship between register values and brightness of the display panel; and a Gamma debugging module, configured to perform Gamma debugging on the first display area according to the plurality of first target brightness values.

According to the method and apparatus for Gamma debugging provided by embodiments of the present application, on one hand, because the selected test area has the same shape and size as the first display area, the first target brightness values determined based on the first present brightness value of the test area would be more consistent with target brightness actually needed by the first display area, and because the test area is located in the second display area, actual display brightness of the first display area is tend to be consistent with actual display brightness of the second display area, so that brightness consistency of the display panel can be improved and thus user experiences can be improved; on the other hand, there is no need to obtain the present brightness value of the test area by a plurality of times, since a plurality of first target brightness values of the first display area when the first display area corresponds to a plurality of register values under the specified grayscale can be determined according to the linear relationship between register values and brightness of the display panel, by only obtaining the first present brightness value of the test area once, so that a process of Gamma debugging can be simplified and time for Gamma debugging can be shorten.

DETAILED DESCRIPTION

In order to make the objects, technical solutions and advantages of the present application clearer, the present application is further described in details below with reference to the accompany drawings and specific embodiments. It should be understood that the specific embodiments described herein are only for illustration of the present application, and are not for limiting the present application. For those skilled in the art, the present application can be implemented without some of those specific details. The following description of embodiments is only for providing a better understanding of the present application by showing examples of the present application.

In an electronic device, such as a mobile phone and a tablet etc., there is a need to integrate photosensitive components (e.g., front-facing cameras, infrared light sensors, and proximity light sensors) on the side where a display panels is provided. In some embodiments, a light-transmitting display area may be provided on the above-described electronic device, and the photosensitive components may be arranged on the back of the light-transmitting display area, such that all-screen display for the electronic device can be achieved, while proper operations of the photosensitive components can be guaranteed If Gamma debugging is performed on the light-transmitting display area and the main display area based on the same target brightness value, due to a difference in voltage drop in different areas of the display panel, there will still be a problem of brightness inconsistency between the light-transmitting display area and the main display area after the Gamma debugging, resulting in a clear boundary between the light-transmitting display area and the main display area.

In order to solve the above problems, embodiments of the present application provide a method and apparatus for Gamma debugging. Various embodiments of the method and apparatus for Gamma debugging will be described below in connection with the accompanying drawings.

An embodiment of the present application provide a method for Gamma debugging applicable to a display panel. The display panel may be an Organic Light Emitting Diode (OLED) display panel.

Figure 1:
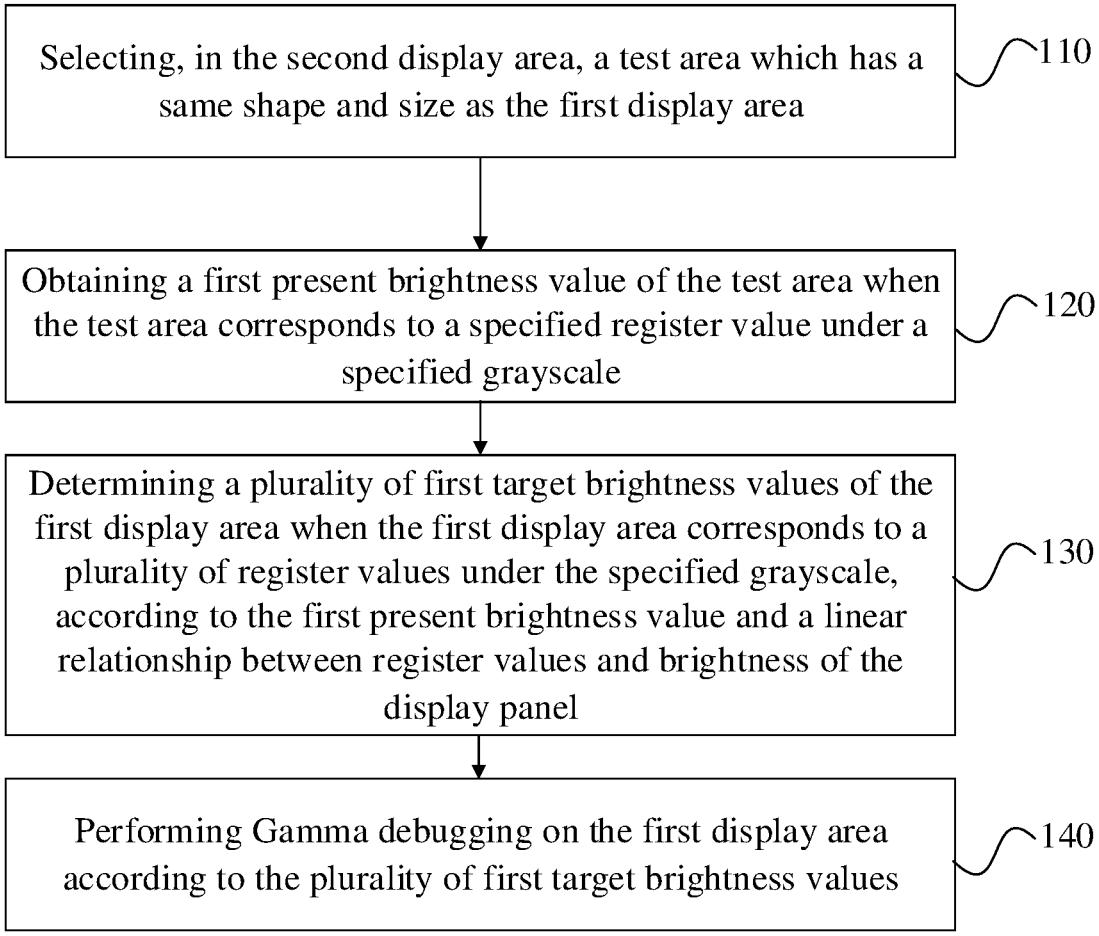
FIG. 1 shows a schematic flowchart of a method for Gamma debugging according to an embodiment of the present application.

As shown in FIG. 1, the method for Gamma debugging provided by the embodiment of the present application may include following steps.

In step 110, a test area which has a same shape and size as a first display area (i.e., a light-transmitting display area) is selected in a second display area (i.e., a main display area).

In step 120, a first present brightness value of the test area is obtained when the test area corresponds to a specified register value under a specified grayscale.

In step 130, a plurality of first target brightness values of the first display area when the first display area corresponds to a plurality of register values under the specified grayscale are determined according to the first present brightness value and a linear relationship between register values and brightness of the display panel.

In step 140, Gamma debugging is performed on the first display area according to the plurality of first target brightness values.

Figure 2:
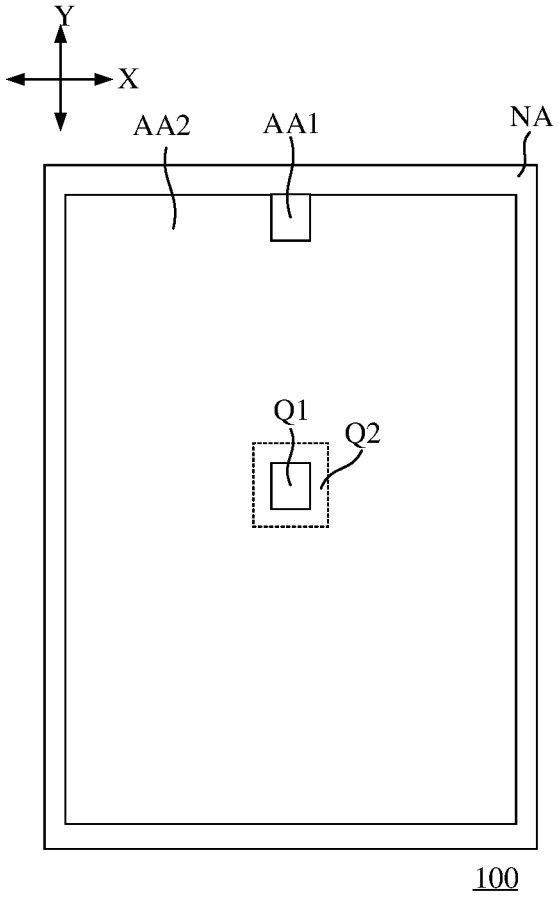
FIG. 2 shows a schematic structural diagram of a top view of a display panel provided by an embodiment of the present application.

The method for Gamma debugging provided by the embodiment of the present application may be applied to a display panel shown in FIG. 2. As shown in FIG. 2, the display panel 100 has a first display area AA1, a second display area AA2, and a non-display area NA surrounding the first display area AA1 and the second display area AA2. A light transmittance of the first display area AA1 is greater than a light transmittance of the second display area AA2.

In the present application, the light transmittance of the first display area AA1 may be greater than or equal to 15%. In order to ensure that the light transmittance of the first display area AA1 is greater than or equal to 15%, or even greater than 40% or more, light transmittances of at least some functional film layers of the display panel 100 in the embodiment may be greater than 80%, or even light transmittances of at least some functional film layers may be greater than 90%.

The light transmittance of the first display area AA1 is greater than the light transmittance of the second display area AA2, so that photosensitive components may be integrated on the back of the first display area AA1 of the display panel 100 to achieve under-screen integration of the photosensitive components such as cameras, while the first display area AA1 can display pictures. Thus, a display area of the display panel 100 can be increased and a full-screen design of a display apparatus can be realized.

In some embodiments, a shape of the first display area AA1 may be a circle, a rectangle, an ellipse, etc., which is not limited herein. Usually, the light transmittance of the first display area AA1 can be improved by reducing a pixel density of the first display area AA1. However, a display effect will deteriorate with the reduction of the pixel density. Therefore, a size of the first display area AA1 can be set to be as small as possible, as long as it is enough to cover a photosensitive surface of the photosensitive component.

According to the method for Gamma debugging provided by embodiment of the present application, on one hand, because the selected test area has the same shape and size as the first display area, the first target brightness values determined based on the first present brightness value of the test area would be more consistent with target brightness actually required for Gamma debugging of the first display area, and because the test area is located in the second display area, actual display brightness of the first display area is tend to be consistent with actual display brightness of the second display area, so that brightness consistency of the display panel can be improved and thus user experiences can be improved; on the other hand, there is no need to obtain the present brightness value of the test area by a plurality of times, since a plurality of first target brightness values of the first display area when the first display area corresponds to a plurality of register values under the specified grayscale can be determined according to the linear relationship between register values and brightness of the display panel, by only obtaining the first present brightness value of the test area once, so that a process of Gamma debugging can be simplified and the efficiency of Gamma debugging can be improved.

In step 110, the selected test area Q1 may be located at anywhere in the second display area AA2. Different display panels may have differences in shape and size. In some embodiments, as shown in FIG. 2, a center point of the test area Q1 may coincide with a center point of the display panel 100. As such, it is possible to avoid moving a position of optical measurement equipment repeatedly to obtain brightness of test areas of different display panels, so as to further improve the efficiency of Gamma debugging.

In step 120, the specified grayscale may be any grayscale. Exemplarily, the specified grayscale may be 255 grayscale.

In some embodiments, a register value may be a value from "000" to "FFF" in hexadecimal notation. A register value may represent a brightness level parameter of the display panel, and different register values may represent different display brightness levels when the same picture is displayed. For example, a register value of "FFF" may represent the maximum display brightness level corresponding to the brightest state, and a register value of "000" may represent the minimum display brightness level corresponding to the darkest state. Register values corresponding to the same picture may range from "000" to "FFF".

In some embodiments, a type of a Gamma register may be a 51 register and the register values may be 51 register values.

In some embodiments, the specified register value may be any register value. For example, the specified register value may be "7FF".

In step 120, the first present brightness value of the test area when the test area corresponds to the register value of "7FF" under the 255 grayscale may be obtained, i.e., the first present brightness value of the test area when the test area corresponds to the register value of "7FF" and is displaying a white picture may be obtained. In some embodiments, optical measurement equipment, such as a color analyzer CA310 or a color analyzer CA410, may be used to measure the brightness of the test area. During a measurement process, a center point of a lens of the optical measurement equipment may be aligned with the center point of the test area to obtain the brightness value of the test area more accurately.

In step 130, under the specified grayscale, the plurality of register values of the first display area correspond to the plurality of first target brightness values of the first display area in a one-to-one corresponding relationship.

Figure 3:
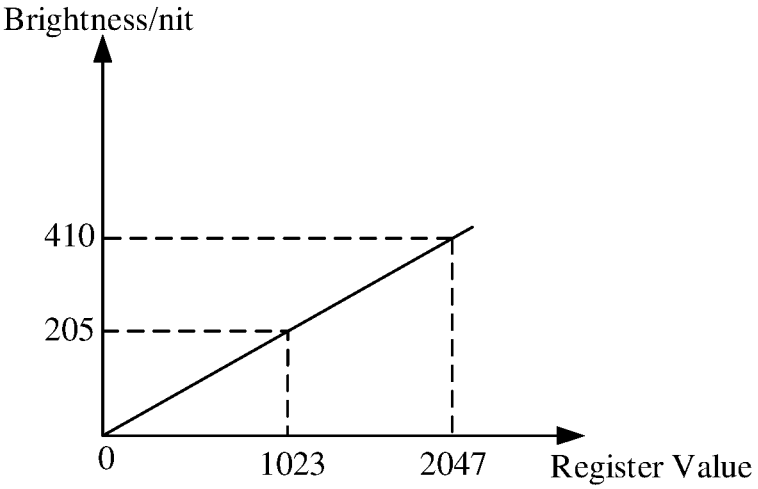
FIG. 3 shows a schematic diagram of a relationship between register values and brightness of a display panel provided by an example.

As shown in FIG. 3, register values of the display panel may have a linear relationship with brightness values of the second display area of the display panel, and the linear relationship between them may be illustrated as a straight line passing through the origin.

In some embodiments, step 130 may specifically include: setting the first present brightness value as the first target brightness value of the first display area when the first display area corresponds to the specified register value under the specified grayscale; obtaining a second present brightness value of the second display area when the second display area corresponds to the specified register value under the specified grayscale; and setting a ratio of a first product to a second product as the first target brightness value of the first display area when the first display area corresponds to another register value under the specified grayscale, where the first product is a product of the second present brightness value and the another register value, and the second product is a product of the specified register value and a coefficient M which is a ratio of the second present brightness value to the first present brightness value, and the another register value is any one of the plurality of register values other than the specified register value.

Figure 4:
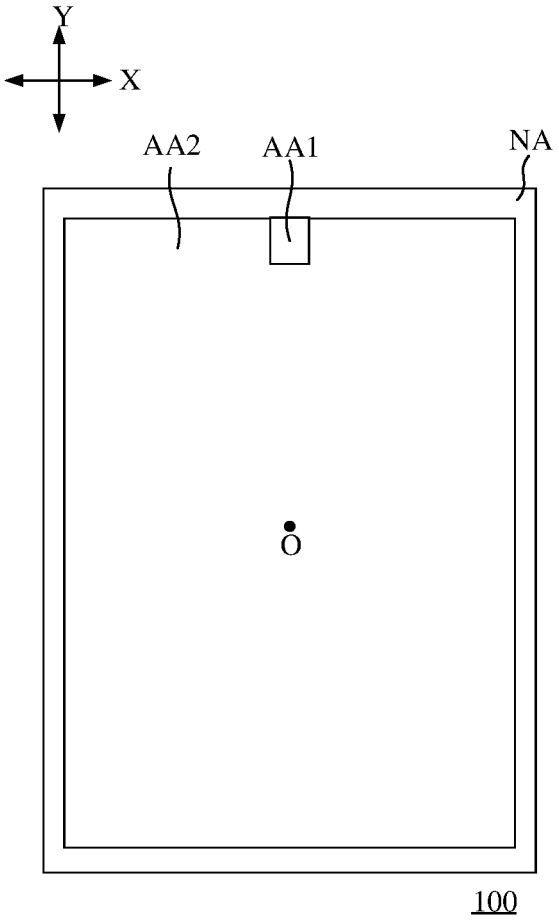
FIG. 4 shows a schematic structural diagram of a top view of a display panel provided another example.

It is taken as an example that the specified grayscale is 255 grayscale and the specified register value is "7FF". As shown in FIG. 4, both the first display area AA1 and the second display area AA2 of the display panel 100 are controlled to display normally, i.e., the entire display panel is controlled to display a white picture. Then, the second present brightness value $L2_{7FF}$ of the second display area when the second display area corresponds to the register value of "7FF" under the 255 grayscale may be obtained. During a measurement process, a center point of a lens of optical measurement equipment may be aligned with a center point of the second display area AA2 to obtain the brightness value of the second display area AA2 more accurately.

Under the same grayscale, when register values are different, a ratio of a brightness value of the second display area to a brightness value of the first display area may be constant. Exemplarily, the first present brightness value of the test area when the test area corresponds to the register value of "7FF" under the 255 grayscale may be $L1_{7FF}$, which can be taken directly as the first target brightness value of the first display area when the first display area corresponds to the register value of "7FF" under the 255 grayscale when the test area has the same shape and size as the first display area. A first target brightness value of the first display area when the first display area corresponds to another register value under the 255 grayscale may be calculated in accordance with equation (1) as shown below.

$$L1_x = \frac{L2_x}{M} \tag{1}$$

In equation (1), $L1_x$ denotes a first target brightness value of the first display area when the first display area corresponds to a register value of X under the 255 grayscale, $L2_x$ denotes a present brightness value of the second display area when the second display area corresponds to the register value of X under the 255 grayscale, and M denotes a ratio of the second present brightness value $L2_{7FF}$ to the first present brightness value $L1_{7FF}$. Exemplarily, a value of M may range from 2 to 2.5, which is not limited herein.

There is a linear relationship between the register values of the display panel and brightness values of the display panel. $L2_x$ may be calculated according to equation (2) as shown below.

$$L2_x = \frac{L2_{7FF}}{7FF} \times X \tag{2}$$

A register value expressed in hexadecimal may be converted to be expressed in decimal. "7FF" in hexadecimal may be converted to 2047 in decimal. Exemplary, L27FF is 410 nit, $L2_{3FF}$ is about 205 nit when X is "3FF", since "3FF" in hexadecimal can be converted to 1023 in decimal. In above equations (1) and (2), $L2_{7FF} \times X$ is the first product, 7FF×M is the second product, and M is $$\frac{L2_{7FF}}{L1_{7FF}}.$$

According to the embodiment of the present application, a present brightness of the second display area when the second display area corresponds to any register value can be calculated, and a first target brightness value of the first display area when the first display area corresponds to any register value can be calculated in turn, by only measuring the present brightness value of the second display area when the second display area corresponds to the specified register value once. A plurality of measurements of the present brightness of the second display area or the test area can be avoided and then the efficiency of Gamma debugging can be improved, while it can be guaranteed that the determined first target brightness value is more consistent with target brightness actually needed by the Gamma debugging of the first display area.

The register values of the display panel may have a linear relationship with brightness values of the first display area of the display panel, and the linear relationship between them may be illustrated as a straight line passing through the origin, too. In some other embodiments, step 130 may specifically include: setting the first present brightness value as the first target brightness value of the first display area when the first display area corresponds to the specified register value under the specified grayscale; calculating a third product of the first present brightness value and another register value; and setting a ratio of the third product to the specified register value as the first target brightness value of the first display area when the first display area corresponds to the another register value under the specified grayscale, where the another register value is any one of the plurality of register values other than the specified register value.

Exemplarily, the first present brightness value of the test area when the test area corresponds to a register value of "7FF" under the 255 grayscale may be $L1_{7FF}$, which can be taken directly as the first target brightness value of the first display area when the first display area corresponds to the register value of "7FF" under the 255 grayscale, since the test area has the same shape and size as the first display area. A first target brightness value $L1_x$ of the first display area when the first display area corresponds to another register value under the 255 grayscale may be calculated in accordance with equation (3) as shown below.

$$L1_x = \frac{L1_{7FF}}{7FF} \times X \tag{3}$$

In above equation (3), $L1_{7FF} \times X$ is the third product. Likewise, register values expressed in hexadecimal can be converted to be expressed in decimal.

According to the embodiment of the present application, a first target brightness value of the first display area when the first display area corresponds to any register value can be calculated, by only measuring the present brightness value of the test area once. A plurality of measurements of the present brightness of the second display area or the test area can be avoided and then the efficiency of Gamma debugging can be improved, while it can be guaranteed that the determined first target brightness value is more consistent with target brightness actually needed by the Gamma debugging of the first display area.

In some optional embodiments, as shown in FIG. 2, the second display area may further include an auxiliary area Q2 at least partially surrounding the test area Q1. Before step 120, the method may further include: controlling the auxiliary area Q2 to all black display, and controlling the first display area AA1 and any area of the second display area AA2 other than the auxiliary area Q2 to gray scale display.

Exemplarily, the first grayscale is 255 grayscale, the auxiliary area Q2 may be controlled to all black display, and the first display area AA1 and any area of the second display area AA2 other than the auxiliary area Q2 may be controlled to display a white picture normally. Optical measurement equipment, such as a color analyzer, may have a shading structure provided on the peripheral of its lens. On one hand, since the auxiliary area Q2 is controlled to all black display, the lens of the optical measurement equipment can be better aligned to the test area Q1, so as to measure the brightness value of the test area Q1 more accurately; on the other hand, since the auxiliary area Q2 is controlled to all black display, a brightness of a display area around the test area Q1 can be prevented from interfering with the test area Q1, so as to measure the brightness value of the test area Q1 accurately.

In the above embodiment, the auxiliary area at least partially surround the test area. It should be understood that a shape of the auxiliary area should match that of the test area. In addition, a size of the auxiliary area in a first direction and/or a second direction does not need to be too large, as long as the size of the auxiliary area is set to achieve an effect of aligning the lens of the optical measuring device with the test area.

In some optional embodiments, step 140 may specifically include: performing Gamma debugging on the first display area according to each of the plurality of first target brightness values, to obtain a target data voltage value corresponding to each sub-pixel in the first display area.

Exemplarily, by step 140, a target data voltage value corresponding to each sub-pixel when first display area corresponds to the register value of "7FF" under the 255 grayscale and a target data voltage value corresponding to each sub-pixel when the first display area corresponds to another register value under the 255 grayscale can be obtained. Each of the above target data voltage values can be stored in an Integrated Circuit (IC) of the display panel, so that actual display brightness of the first display area conforms to each first target brightness value.

Figure 5:
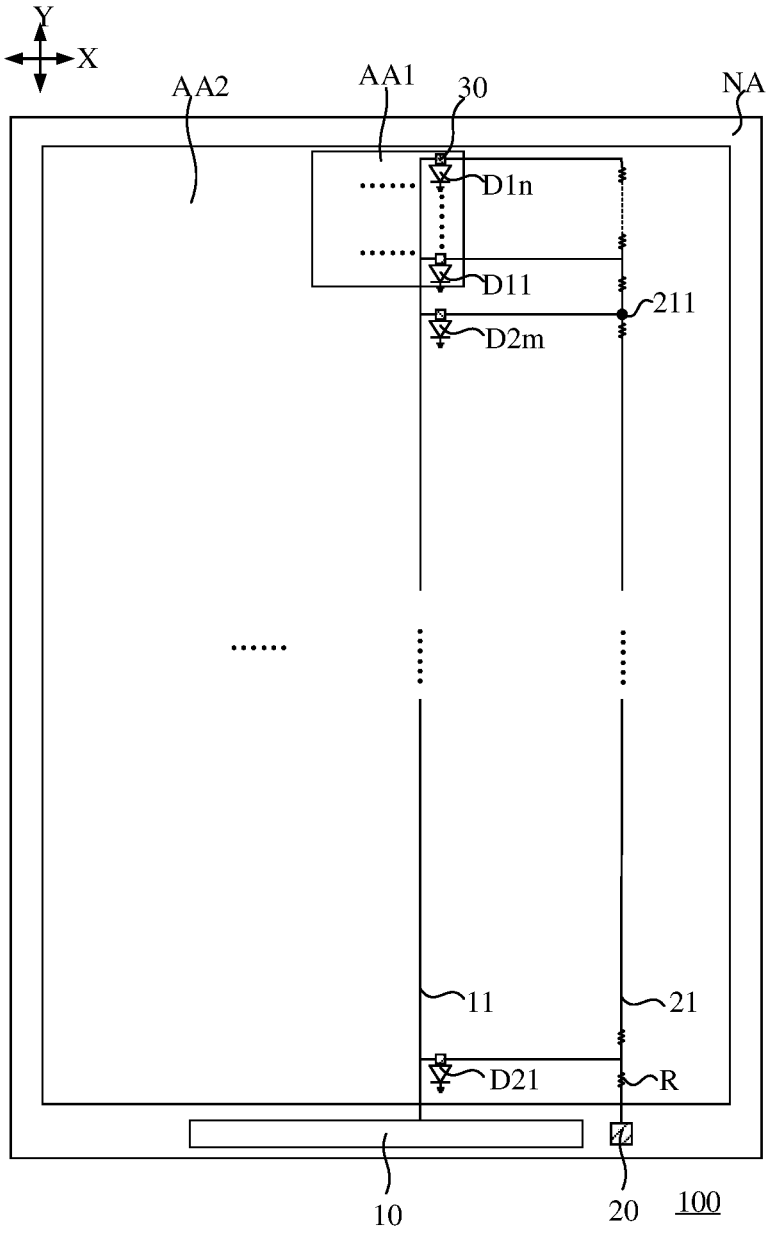
FIG. 5 shows a schematic diagram of a voltage drop of a display panel according to an embodiment of the present application.

As shown in FIG. 5, a data driving circuit 10 and a total supply voltage terminal 20 of the display panel 100 may be located in the non-display area NA of the display panel 100, and on either side of the first display area AA1 in the second direction Y. The data driving circuit 10 and the total supply voltage terminal 20 are arranged on the same side. Exemplarily, the display panel 100 may include n rows of sub-pixels D11~D1*n* in the first display area AA1, and the display panel 100 may totally include m rows of sub-pixels D21~D2*m* in the second display area AA2. The data driving circuit 10 may be electrically connected to a pixel circuit 30 for each sub-pixel in the first display area AA1 and the second display area AA2 through a data line 11, and provide a light-emitting signal to the sub-pixel of the display panel 100 through the data line 11, so that the display panel 100 displays a preset image. The total supply voltage terminal 20 may be electrically connected to the pixel circuit 30 for each sub-pixel in the first display area AA1 and the second display area AA2 through a supply voltage line 21.

The data line 11 and the supply voltage line 21 have their own resistance values. In the second direction Y and the direction away from the data driving circuit 10 and the total supply voltage terminal 20, voltage drops (IR drop) on the data line 11 and the supply voltage line 21 are gradually increasing, and a current value on the data line 11 is very small and at a level of microamp, while a current value on the supply voltage line 21 is usually at a level of milliamp, which is much larger than the current value on the data line 11, and thus the voltage drop on the data line 11 may be ignored. It can be understood that the data voltage value outputted by the data driving circuit 10 is the data voltage value actually obtained by each row of sub-pixels, and the supply voltage value actually obtained by each row of sub-pixels is smaller than the supply voltage value outputted by the total supply voltage terminal 20.

In addition, the Gamma debugging is holistic debugging, that is, respective target data voltage values obtained by step 140 and corresponding to respective sub-pixels may be the same value "Data" when the first display area corresponds to the register value of "7FF" and other register values under the 255 grayscale. In order to compensate an effect of a threshold voltage Vth of a transistor in a pixel circuit corresponding to a sub-pixel, a current I flowing through the sub-pixel is proportional to $(Vdd-Data)^2$ and display brightness of the sub-pixel is proportional to the current I flowing through the sub-pixel, and thus the brightness of the sub-pixel is proportional to $(Vdd-Data)^2$. Supply voltage values Vdd actually obtained by sub-pixels located in different rows are different. If the same data voltage value Data obtained by Gamma debugging is provided to different rows of sub-pixels, different rows of sub-pixels would not have the same actual display brightness.

In order to avoid an influence of the voltage drop (IR drop) on the supply voltage line 21, for example, the display panel may include n rows of sub-pixels in the first display area, where n is a positive integer greater than or equal to 1. In some optional embodiments, the method may further include following steps after step 140.

In step 150, a target current value corresponding to each sub-pixel in the first display area is determined based on the target data voltage value corresponding to each sub-pixel in the first display area.

In step 160, a supply voltage value actually obtained by each sub-pixel in the first display area is obtained based on the target current value corresponding to each sub-pixel in the first display area.

In step 170, a data voltage value outputted by a data driving circuit of the display panel is calculated in accordance with equation (4) below:

$$\text{Data}'=\text{Data}-(Vdd-Vdd_x) \tag{4}$$

In equation (4), Data denotes the data voltage value outputted by the data driving circuit of the display panel, Data denotes the target data voltage value, Vdd denotes a supply voltage value outputted by a supply voltage terminal of the first display area, $Vdd_x$ denotes a supply voltage value actually obtained by each sub-pixel in row x of the first display area, and x is a positive integer greater than or equal to 1 and less than or equal to n.

In step 150, the target current value corresponding to each sub-pixel in the first display area may be calculated in accordance with equation (5) below:

$$I=k(Vdd-\text{Data})^2 \tag{5}$$

In equation (5), k is a known coefficient and is determined by a channel length and width of a transistor in a pixel circuit corresponding to the sub-pixel.

According to the embodiment of the present application, the data voltage value Data outputted by a data driving circuit required by any row of sub-pixels in the first display area can be determined accurately, and the data voltage value Data' outputted by the data driving circuit may be stored in the integrated circuit IC of the display panel, so that the actual display brightness of the first display area can be more consistent with each first target brightness value.

In some optional embodiments, each column of sub-pixels in the first display area are electrically connected to the supply voltage terminal 211 of the first display area through a supply voltage line, and the sub-pixels, closest to the supply voltage terminal 211, in respective columns of sub-pixels constitute a first row of sub-pixels. As shown in FIG. 5, one supply voltage line 21 can be electrically connected to sub-pixels of the first display area AA1 and sub-pixels of the second display area AA2 at the same time, that is, a supply voltage value of the supply voltage terminal 211 of the first display area AA1 can be provided by the total supply voltage terminal 20 of the display panel 100. The supply voltage value of the supply voltage terminal 211 of the first display area AA1 may be the same as a supply voltage value actually obtained by the $m^{th}$ row of sub-pixels D2*m* of the second display area AA2.

Exemplarily, the supply voltage value actually obtained by each sub-pixel in the first display area may be calculated in accordance with equation (6) below:

$$Vdd_x=Vdd-(x\times I_{tatal}-\Sigma_{i=1}^{x-1}(x-i)I_i)\times R \tag{6}$$

In equation (6), $I_{tatal}$ denotes a total current value outputted by the supply voltage terminal 211 of the first display area, denotes a target current value corresponding to an $i^{th}$ row of sub-pixels, i is greater than or equal to 1 and less than or equal to x, and R denotes a resistance value of a supply voltage line between two adjacent rows of sub-pixels.

Figure 6:
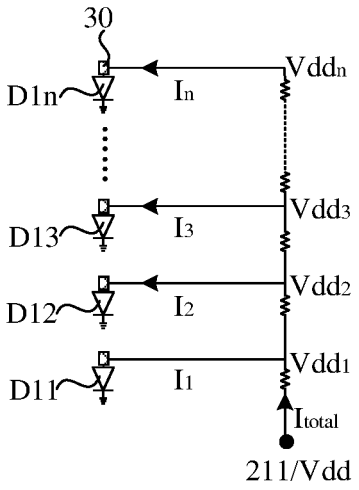
FIG. 6 shows a schematic diagram of a voltage drop after the display panel is omitted according to another embodiment of the present application.

As shown in FIG. 6, a column of sub-pixels D11~D1*n* in the first display area AA1 is taken as an example. The supply voltage line has its own resistance. The voltage drop dVdd on the supply voltage line may be calculated according to following equations.

$$dVdd_1=I_{tatal}\times R \tag{7}$$

$$dVdd_2=(I_{tatal}-I_1)\times R \tag{8}$$

$$dVdd_3=(I_{tatal}-I_1-I_2)\times R \tag{9}$$

$$dVdd_n=(I_{tatal}-\Sigma_{i=1}^{n-1}I_i)\times R \tag{10}$$

Further, the supply voltage value $Vdd_x$ actually obtained by each sub-pixel in this column may be calculated according to following equations.

$$Vdd_1=Vdd-dVdd_1 \tag{11}$$

$$Vdd_2=Vdd-dVdd_1-dVdd_2 \tag{12}$$

$$Vdd_3=Vdd-dVdd_1-dVdd_2-dVdd_3 \tag{13}$$

$$Vdd_n=Vdd-(n\times I_{tatal}-\Sigma_{i=1}^{n-1}(n-i)I_i\times R \tag{14}$$

According to the embodiment of the present application, the supply voltage value actually obtained by any row of sub-pixels in the first display area can be determined accurately, and further, the data voltage value Data outputted by the data driving circuit required by any row of sub-pixels in the first display area can be determined accurately.

In some optional embodiments, the method for Gamma debugging provided by the embodiment of the present application may further include: determining a second target brightness value of the second display area under the first grayscale according to a target requirement; and performing Gamma debugging on the second display area according to the second target brightness value, so that a difference between an actual brightness value of the second display area and the second target brightness value of the second display area is within a first preset range.

Specifically, the above steps may be performed before step 110, that is, the Gamma debugging on the second display area AA2 may be performed firstly, enabling the actual brightness value of the second display area AA2 to meet actual demands.

Exemplarily, the target requirement may be a customer requirement. A customer generally may propose a brightness requirement of a white picture. i.e., a brightness requirement under the 255 grayscale. If the first grayscale is the 255 grayscale, the second target brightness value is the brightness requirement of a white picture proposed by the customer. If the first grayscale is another grayscale value, the second target brightness value of the second display area AA2 under the first grayscale may be calculated according to equation (15) below.

$$L_s=L_{255}*(S/255)^T*100\% \tag{15}$$

In above equation (15), $L_{255}$ denotes the brightness value corresponding to the 255 grayscale, which is generally given in the target requirement, S denotes the value of the first grayscale, T denotes a Gamma value (exemplarily, T may be 2.2), and $L_s$ denotes the second target brightness value of the second display area AA2 under the first grayscale.

Performing Gamma debugging on the second display area according to the second target brightness value, may specifically include: providing a grayscale voltage to sub-pixels in the second display area AA2 and adjusting a value of the grayscale voltage continuously, until the difference between the actual brightness value and the second target brightness value of the second display area AA2 is within the first preset range, so as to meet the target requirement. Additionally, a specific value of the first preset range may be set according to actual demands. For example, the first preset range may be −43 nit~43 nit, which is not limited herein.

According to the embodiment of the present application, the Gamma debugging on the second display area can be performed according to the target requirement firstly to meet actual demands, so as to guarantee that the first display also meet actual demands, when there is no obvious difference in brightness between the first display area and the second display area.

In some optional embodiments, the method for Gamma debugging provided by the embodiment of the present application may further include: performing a voltage drop compensation on the second display area, so that a difference between a brightness value of the first display area under the first grayscale and an average brightness value of the second display area under the first grayscale is within a second preset range.

Particularly, the above step may be performed before the step of performing Gamma debugging on the second display area. As mentioned above, in the direction away from the data driving circuit 10 and the total supply voltage terminal 20, the voltage drops (IR drops) on the data line and the supply voltage line increase gradually. Therefore, different positions in the second display area may have different display brightness. The voltage drop compensation on the second display may guarantee that the display brightness at different positions of the second display area is consistent with the overall brightness of the second display area, that is, the brightness value of the first display area under the first grayscale is tend to be consistent with the average brightness value of the second display area under the first grayscale.

In addition, a specific value of the second preset range may be set according to actual demands. For example, the second preset range may be 8.6 nit~15 nit, which is not limited herein.

In some optional embodiments, step 140 may include: calculating, based on the first target brightness value of the first display area under the specified grayscale, first target brightness values of the first display area under other grayscales; and performing Gamma debugging on the first display area according to the first target brightness value of the first display area under the specified grayscale and the first target brightness values of the first display area under the other grayscales.

Particularly, the first target brightness values of the first display area under the other grayscales may be calculated according to above equation (15). A preset Gamma value may be 2.2 or any other value.

Figure 7:
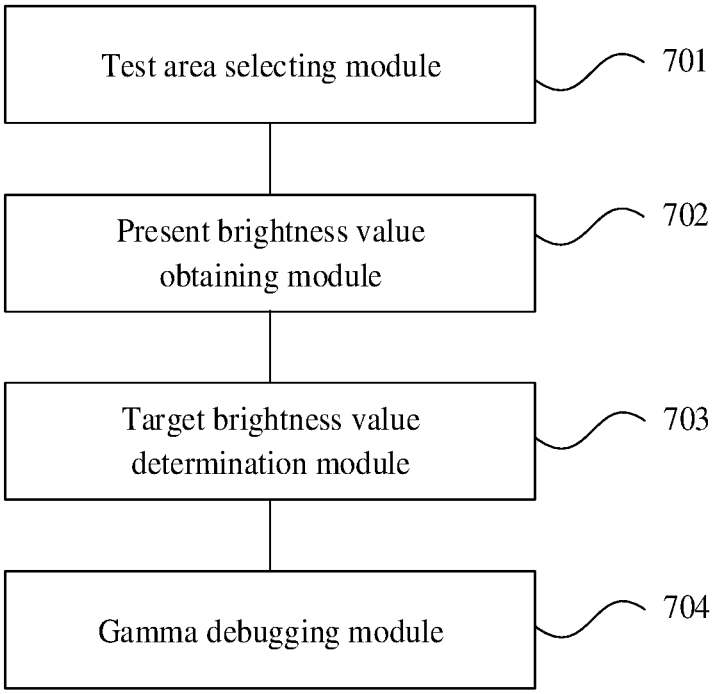
FIG. 7 shows a schematic structural diagram of an apparatus for Gamma debugging according to an embodiment of the present application.

FIG. 7 shows a schematic structural diagram of an apparatus for Gamma debugging according to an embodiment of the present application. The apparatus for Gamma debugging may be applied to the above display panel. As shown in FIG. 7, the apparatus for Gamma debugging provided by the embodiment of the present application may include following modules.

A test area selecting module 701 is configured to select, in the second display area, a test area which has a same shape and size as the first display area.

A present brightness value obtaining module 702 is configured to obtain a first present brightness value of the test area when the test area corresponds to a specified register value under a specified grayscale A target brightness value determination module 703 is configured to determine a plurality of first target brightness values when the first display area corresponds to a plurality of register values under the specified grayscale, according to the first present brightness value and a linear relationship between register values and brightness of the display panel.

A Gamma debugging module 704 is configured to perform Gamma debugging on the first display area according to the plurality of first target brightness values.

According to the apparatus for Gamma debugging provided by embodiment of the present application, on one hand, because the selected test area has the same shape and size as the first display area, the first target brightness values determined based on the first present brightness value of the test area would be more consistent with target brightness actually needed by the first display area, and because the test area is located in the second display area, actual display brightness of the first display area is tend to be consistent with actual display brightness of the second display area, so that brightness consistency of the display panel can be improved and thus user experiences can be improved; on the other hand, there is no need to obtain the present brightness value of the test area by a plurality of times, since a plurality of first target brightness values of the first display area when the first display area corresponds to a plurality of register values under the specified grayscale can be determined according to the linear relationship between register values and brightness of the display panel, by only obtaining the first present brightness value of the test area once, so that a process for Gamma debugging can be simplified and time for Gamma debugging can be shorten.

In some optional embodiments, the target brightness value determination module 703 may be specifically configured to:

- set the first present brightness value as the first target brightness value of the first display area when the first display area corresponds to the specified register value under the specified grayscale;
- obtain a second present brightness value of the second display area when the second display area corresponds to the specified register value under the specified grayscale; and
- set a ratio of a first product to a second product as the first target brightness value of the first display area when the first display area corresponds to another register value under the specified grayscale,
- wherein the first product is a product of the second present brightness value and the another register value, and the second product is a product of the specified register value and a coefficient M which is a ratio of the second present brightness value to the first present brightness value, and the another register value is any one of the plurality of register values other than the specified register value.

According to the embodiment of the present application, present brightness of the second display area when the second display area corresponds to any register value can be calculated, and a first target brightness value of the first display area when the first display area corresponds to any register value can be calculated in turn, by only measuring the present brightness value of the second display area when the second display area corresponds to the specified register value once. A plurality of measurements of the present brightness of the second display area or the test area can be avoided and then the efficiency of Gamma debugging can be improved, while it can be guaranteed that the determined first target brightness value is more consistent with target brightness actually needed by the Gamma debugging of the first display area.

In some optional embodiments, the target brightness value determination module 703 may be specifically configured to:

set the first present brightness value as the first target brightness value of the first display area when the first display area corresponds to the specified register value under the specified grayscale;

calculate a third product of the first present brightness value and another register value; and set a ratio of the third product to the specified register value as the first target brightness value of the first display area when the first display area corresponds to the another register value under the specified grayscale, wherein the another register value is any one of the plurality of register values other than the specified register value.

According to the embodiment of the present application, a first target brightness value of the first display area when the first display area corresponds to any register value can be calculated, by only measuring the present brightness value of the test area once. A plurality of measurements of the present brightness of the second display area or the test area can be avoided and then the efficiency of Gamma debugging can be improved, while it can be guaranteed that the determined first target brightness value is more consistent with target brightness actually needed by the Gamma debugging of the first display area.

In some optional embodiments, the apparatus may further include a control module which is configured to control the auxiliary area to all black display, and control the first display area and any area of the second display area other than the auxiliary area to gray scale display.

On one hand, since the auxiliary area Q2 is controlled to all black display, the lens of the optical measurement equipment can be better aligned to the test area Q1, so as to measure the brightness value of the test area Q1 more accurately; on the other hand, since the auxiliary area Q2 is controlled to all black display, a brightness of a display area around the test area Q1 can be prevented from interfering with the test area Q1, so as to measure the brightness value of the test area Q1 accurately.

In some optional embodiments, the Gamma debugging module 704 may be specifically configured to:

perform Gamma debugging on the first display area according to each of the plurality of first target brightness values, to obtain a target data voltage value corresponding to each sub-pixel in the first display area.

The above target data voltage values may be stored in an integrated circuit (IC) of the display panel, so that the actual display brightness of the first display area is consistent with each first target brightness value.

In some optional embodiments, the display panel may include n rows of sub-pixels in the first display area, n is a positive integer greater than or equal to 1, and the Gamma debugging module may further include a data voltage determination module, configured to:

determine a target current value corresponding to each sub-pixel in the first display area, based on the target data voltage value corresponding to each sub-pixel in the first display area;

determine a supply voltage value actually obtained by each sub-pixel in the first display area based on the target current value corresponding to each sub-pixel in the first display area;

calculate a data voltage value outputted by a data driving circuit of the display panel in accordance with an equation below:

$$\text{Data}=\text{Data}-(Vdd-Vdd_x).$$

In the equation, Data denotes the data voltage value outputted by the data driving circuit of the display panel, Data denotes the target data voltage value, Vdd denotes a supply voltage value outputted by a supply voltage terminal of the first display area, $Vdd_x$ denotes a supply voltage value actually obtained by each sub-pixel in row x of the first display area, and x is a positive integer greater than or equal to 1 and less than or equal to n.

According to the embodiment of the present application, the data voltage value Data outputted by a data driving circuit required by any row of sub-pixels in the first display area can be determined accurately, and the data voltage value Data' outputted by the data driving circuit may be stored in the integrated circuit IC of the display panel, so that the actual display brightness of the first display area can be more consistent with each first target brightness value.

In some optional embodiments, each column of sub-pixels in the first display area are electrically connected to the supply voltage terminal of the first display area via a supply voltage line, and the sub-pixels, closest to the supply voltage terminal, in respective columns of sub-pixels constitute a first row of sub-pixels, and the data voltage determination module may be specifically configured to:

calculate the supply voltage value actually obtained by each sub-pixel in the first display area in accordance with an equation below:

$$Vdd_x=Vdd-(x\times I_{tatal}-\Sigma_{i=1}^{x-1}(x-i)I_i)\times R$$

In the equation, $I_{tatal}$ denotes a total current value outputted by the supply voltage terminal of the first display area, $I_i$ denotes a target current value corresponding to an $i^{th}$ row of sub-pixels, i is greater than or equal to 1 and less than or equal to x, and R denotes a resistance value of a supply voltage line between two adjacent rows of sub-pixels.

According to the embodiment of the present application, the supply voltage value actually obtained by any row of sub-pixels in the first display area can be determined accurately, and further, the data voltage value Data' to be outputted by the data driving circuit required by any row of sub-pixels in the first display area can be determined accurately.

In some optional embodiments, the Gamma debugging module 704 may be further configured to:

determine a second target brightness value of the second display area under the specified grayscale according to a target requirement; and perform Gamma debugging on the second display area according to the second target brightness value, so that a difference between an actual brightness value of the second display area and the second target brightness value of the second display area is within a preset range.

According to the embodiment of the present application, the Gamma debugging on the second display area can be performed according to the target requirement firstly to meet actual demands, so as to guarantee that the first display also meet actual demands, when there is no obvious difference in brightness between the first display area and the second display area.

In some optional embodiments, a center point of the test area coincides with a center point of the display panel. As such, it is possible to avoid moving a position of optical measurement equipment repeatedly to obtain brightness of test areas of different display panels, so as to further improve the efficiency of Gamma debugging.

The functional blocks shown in the above structural block diagrams may be implemented as hardware, software, firmware, or a combination thereof. When implemented in hardware, the functional blocks may be, for example, electronic circuits, application specific integrated circuits (ASICs), appropriate firmware, plug-ins, function cards, and so on. When implemented in software, elements of the present application may be programs or code segments used to perform required tasks. The programs or code segments may be stored in a readable medium of the machine, or may be transmitted on a transmission medium or a communication link via a data signal carried in a carrier wave. The "a readable medium of the machine" may include any medium which can store or transmit information. Examples of the readable medium of the machine may include an electronic circuit, a semiconductor memory device, a ROM, a flash memory, an erasable ROM (EROM), a floppy disk, a CD-ROM, an optical disk, a hard disk, a fiber medium, a radio frequency (RF) link, and so forth. A code segment may be downloaded via a computer network such as the Internet, an intranet, etc.

The embodiments of the present application as described above do not exhaust all the details and do not limit the scope of the present application. Obviously, many modifications and variations can be made by those of ordinary skills in the art in light of the above description. These embodiments are specifically described in this specification to better explain principles and practical applications of the present application, so that those skilled in the art can make good use of the present application and make modifications based on the present application. The scope of the present application is limited only by the appended claims.

What is claimed is:

1. A method for Gamma debugging, applicable to a display panel comprising a first display area and a second display area, a light transmittance of the first display area being greater than a light transmittance of the second display area, the method comprising:

selecting, in the second display area, a test area which has a same shape and size as the first display area;

obtaining a first present brightness value of the test area when the test area corresponds to a specified register value under a specified grayscale;

determining a plurality of first target brightness values of the first display area when the first display area corresponds to a plurality of register values under the specified grayscale, according to the first present brightness value and a linear relationship between register values and brightness of the display panel; and performing Gamma debugging on the first display area according to the plurality of first target brightness values, wherein determining a plurality of first target brightness values of the first display area when the first display area corresponds to the plurality of register values under the specified grayscale, according to the first present brightness value and the linear relationship between register values and brightness of the display panel comprises:

setting the first present brightness value as the first target brightness value of the first display area when the first display area corresponds to the specified register value under the specified grayscale;

obtaining a second present brightness value of the second display area when the second display area corresponds to the specified register value under the specified grayscale; and setting a ratio of a first product to a second product as the first target brightness value of the first display area when the first display area corresponds to another register value under the specified grayscale, wherein the first product is a product of the second present brightness value and the another register value, and the second product is a product of the specified register value and a coefficient M which is a ratio of the second present brightness value to the first present brightness value, and the another register value is any one of the plurality of register values other than the specified register value.

2. The method for Gamma debugging of claim 1, wherein determining a plurality of first target brightness values of the first display area when the first display area corresponds to the plurality of register values under the specified grayscale, according to the first present brightness value and the linear relationship between register values and brightness of the display panel comprises:

setting the first present brightness value as the first target brightness value of the first display area when the first display area corresponds to the specified register value under the specified grayscale;

calculating a third product of the first present brightness value and another register value; and setting a ratio of the third product to the specified register value as the first target brightness value of the first display area when the first display area corresponds to the another register value under the specified grayscale, wherein the another register value is any one of the plurality of register values other than the specified register value.

3. The method for Gamma debugging of claim 1, wherein the second display area further comprises an auxiliary area at least partially surrounding the test area, and before obtaining the first present brightness value of the test area when the test area corresponds to the specified register value under the specified grayscale, the method further comprises:

controlling the auxiliary area to all black display, and controlling the first display area and any area of the second display area other than the auxiliary area to gray scale display.

4. The method for Gamma debugging of claim 1, wherein performing Gamma debugging on the first display area according to the plurality of first target brightness values comprises:

performing Gamma debugging on the first display area according to each of the plurality of first target brightness values, to obtain a target data voltage value corresponding to each sub-pixel in the first display area.

5. The method for Gamma debugging of claim 4, wherein the first display area comprises n rows of sub-pixels, n is a positive integer greater than or equal to 1, and after performing Gamma debugging on the first display area according to the plurality of first target brightness values, the method further comprises:

determining a target current value corresponding to each sub-pixel in the first display area, based on the target data voltage value corresponding to each sub-pixel in the first display area, the target current value corresponding to each sub-pixel in the first display area being calculated in accordance with an equation below:

$$1=k(Vdd-\text{Data})^2,$$

wherein k is a known coefficient and is determined by a channel length and width of a transistor in a pixel circuit corresponding to the sub-pixel.

6. The method for Gamma debugging of claim 5, further comprising: determining a supply voltage value actually obtained by each sub-pixel in the first display area based on the target current value corresponding to each sub-pixel in the first display area, a data voltage value outputted by a data driving circuit of the display panel being calculated in accordance with an equation below:

$$\text{Data}'=\text{Data}-(Vdd-Vdd_x),$$

wherein Data' denotes the data voltage value to be outputted by the data driving circuit of the display panel, Data denotes the target data voltage value, Vdd denotes a supply voltage value outputted by a supply voltage terminal of the first display area, $Vdd_x$ denotes a supply voltage value actually obtained by each sub-pixel in row x of the first display area, and x is a positive integer greater than or equal to 1 and less than or equal to n.

7. The method for Gamma debugging of claim 6, wherein each column of sub-pixels in the first display area are electrically connected to the supply voltage terminal of the first display area via a supply voltage line, and the sub-pixels, closest to the supply voltage line, in columns of sub-pixels constitute a first row of sub-pixels, and determining the supply voltage value actually obtained by each sub-pixel in the first display area based on the target current value corresponding to each sub-pixel in the first display area comprises:

calculating the supply voltage value actually obtained by each sub-pixel in the first display area in accordance with an equation below:

$$Vdd_x=Vdd-(x\times I_{tatal}-\Sigma_{i=1}^{x-1}(x-i)I_i)\times R,$$

wherein $I_{tatal}$ denotes a total current value outputted by the supply voltage terminal of the first display area, $I_i$ denotes a target current value corresponding to an $i^{th}$ row of sub-pixels, i is greater than or equal to 1 and less than or equal to x, and R denotes a resistance value of a supply voltage line between two adjacent rows of sub-pixels.

8. The method for Gamma debugging of claim 1, wherein before selecting the test area, the method further comprises:

determining a second target brightness value of the second display area under the specified grayscale according to a target requirement; and performing Gamma debugging on the second display area according to the second target brightness value, so that a difference between an actual brightness value of the second display area and the second target brightness value of the second display area is within a preset range.

9. The method for Gamma debugging of claim 1, wherein a center point of the test area coincides with a center point of the display panel.

10. An apparatus for Gamma debugging, applicable to a display panel comprising a first display area and a second display area, a light transmittance of the first display area being greater than a light transmittance of the second display area, the apparatus comprising:

a test area selecting module, configured to select, in the second display area, a test area which has a same shape and size as the first display area;

a present brightness value obtaining module, configured to obtain a first present brightness value of the test area when the test area corresponds to a specified register value under a specified grayscale;

a target brightness value determination module, configured to determine a plurality of first target brightness values of the first display area when the first display area corresponds to a plurality of register values under the specified grayscale, according to the first present brightness value and a linear relationship between register values and brightness of the display panel; and a Gamma debugging module, configured to perform Gamma debugging on the first display area according to the plurality of first target brightness values, wherein the target brightness value determination module is configured to:

set the first present brightness value as a first target brightness value of the first display area when the first display area corresponds to the specified register value under the specified grayscale;

obtain a second present brightness value of the second display area when the second display area corresponds to the specified register value under the specified grayscale; and set a ratio of a first product to a second product as a first target brightness value of the first display area when the first display area corresponds to another register value under the specified grayscale, wherein the first product is a product of the second present brightness value and the another register value, and the second product is a product of the specified register value and a coefficient M which is a ratio of the second present brightness value to the first present brightness value, and the another register value is any one of the plurality of register values other than the specified register value.

11. The apparatus for Gamma debugging of claim 10, further comprising a control module which is configured to control an auxiliary area of the second display area to all black display, and control the first display area and any area of the second display area other than the auxiliary area to gray scale display.

12. The apparatus for Gamma debugging of claim 10, wherein the Gamma debugging module is configured to perform Gamma debugging on the first display area according to each of the plurality of first target brightness values, to obtain a target data voltage value corresponding to each sub-pixel in the first display area.

13. The apparatus for Gamma debugging of claim 12, wherein the display panel comprises n rows of sub-pixels in the first display area, n is a positive integer greater than or equal to 1, and the Gamma debugging module further comprises a data voltage determination module, configured to:

determine a target current value corresponding to each sub-pixel in the first display area, based on the target data voltage value corresponding to each sub-pixel in the first display area, the target current value corresponding to each sub-pixel in the first display area being calculated in accordance with an equation below:

$$I=k(Vdd-\text{Data})^2,$$

wherein k is a known coefficient and is determined by a channel length and width of a transistor in a pixel circuit corresponding to the sub-pixel.

14. The apparatus for Gamma debugging of claim 13, wherein the data voltage determination module is further configured to determine a supply voltage value actually obtained by each sub-pixel in the first display area based on the target current value corresponding to each sub-pixel in the first display area, a data voltage value outputted by a data driving circuit of the display panel is calculated in accordance with an equation below:

$$\text{Data}'=\text{Data}-(Vdd-Vddx),$$

wherein Data' denotes the data voltage value to be outputted by the data driving circuit of the display panel, Data denotes the target data voltage value, Vdd denotes a supply voltage value outputted by a supply voltage terminal of the first display area, Vddx denotes a supply voltage value actually obtained by each sub-pixel in row x of the first display area, and x is a positive integer greater than or equal to 1 and less than or equal to n.

15. The apparatus for Gamma debugging of claim 14, wherein each column of sub-pixels in the first display area are electrically connected to the supply voltage terminal of the first display area via a supply voltage line, and the sub-pixels, closest to the supply voltage line, in columns of sub-pixels constitute a first row of sub-pixels, and the data voltage determination module is configured to:

calculate the supply voltage value actually obtained by each sub-pixel in the first display area in accordance with an equation below:

$$Vddx=Vdd-(x\times I_{tatal}-\Sigma_{i=1}^{x-1}(x-i)I_i)\times R$$

wherein $I_{tatal}$ denotes a total current value outputted by the supply voltage terminal of the first display area, $I_i$ denotes a target current value corresponding to an $i^{th}$ row of sub-pixels, i is greater than or equal to 1 and less than or equal to x, and R denotes a resistance value of a supply voltage line between two adjacent rows of sub-pixels.

16. A method for Gamma debugging, applicable to a display panel comprising a first display area and a second display area, a light transmittance of the first display area being greater than a light transmittance of the second display area, the method comprising:

selecting, in the second display area, a test area which has a same shape and size as the first display area;

obtaining a first present brightness value of the test area when the test area corresponds to a specified register value under a specified grayscale;

determining a plurality of first target brightness values of the first display area when the first display area corresponds to a plurality of register values under the specified grayscale, according to the first present brightness value and a linear relationship between register values and brightness of the display panel; and performing Gamma debugging on the first display area according to the plurality of first target brightness values, wherein determining a plurality of first target brightness values of the first display area when the first display area corresponds to the plurality of register values under the specified grayscale, according to the first present brightness value and the linear relationship between register values and brightness of the display panel comprises:

setting the first present brightness value as the first target brightness value of the first display area when the first display area corresponds to the specified register value under the specified grayscale;

calculating a third product of the first present brightness value and another register value; and setting a ratio of the third product to the specified register value as the first target brightness value of the first display area when the first display area corresponds to the another register value under the specified grayscale, wherein the another register value is any one of the plurality of register values other than the specified register value.

17. The method for Gamma debugging of claim 16, wherein the second display area further comprises an auxiliary area at least partially surrounding the test area, and before obtaining the first present brightness value of the test area when the test area corresponds to the specified register value under the specified grayscale, the method further comprises:

controlling the auxiliary area to all black display, and controlling the first display area and any area of the second display area other than the auxiliary area to gray scale display.

18. The method for Gamma debugging of claim 16, wherein performing Gamma debugging on the first display area according to the plurality of first target brightness values comprises:

performing Gamma debugging on the first display area according to each of the plurality of first target brightness values, to obtain a target data voltage value corresponding to each sub-pixel in the first display area.

19. The method for Gamma debugging of claim 16, wherein before selecting the test area, the method further comprises:

determining a second target brightness value of the second display area under the specified grayscale according to a target requirement; and performing Gamma debugging on the second display area according to the second target brightness value, so that a difference between an actual brightness value of the second display area and the second target brightness value of the second display area is within a preset range.

20. The method for Gamma debugging of claim 16, wherein a center point of the test area coincides with a center point of the display panel.

* * * * *